United States Patent [19]

Bland et al.

[11] 4,231,316

[45] Nov. 4, 1980

[54] ACTUATION MEANS FOR MARINE PROPULSION DEVICE TRANSMISSION

[75] Inventors: Gerald F. Bland, Kenosha, Wis.; Guy D. Payne, Lake Villa, Ill.

[73] Assignee: Outboard Marine Corporation, Waukegan, Ill.

[21] Appl. No.: 890,499

[22] Filed: Mar. 27, 1978

[51] Int. Cl.[2] ..... B63H 5/13; B63H 21/28; G05G 7/02

[52] U.S. Cl. ..... 440/86; 74/501 R; 74/501.5 R; 74/506; 192/21; 192/99 S

[58] Field of Search ..... 192/21, 51, 99 S; 74/10.7, 89.22, 501 R, 501.5 R, 505, 506; 115/34 R, 35

[56] References Cited

U.S. PATENT DOCUMENTS

| | | | |
|---|---|---|---|
| 2,224,193 | 12/1940 | Mahnken | 74/10.7 X |
| 2,787,169 | 4/1957 | Farr et al. | 74/501 X |
| 2,860,363 | 11/1958 | Howard et al. | 74/501.5 X |
| 3,088,449 | 5/1963 | Hockaday | 74/10.7 X |
| 3,183,880 | 5/1965 | Shimanckas | 115/34 R X |
| 3,747,428 | 7/1973 | Waner et al. | 74/501 X |
| 3,919,964 | 11/1975 | Hagen | 115/34 R |
| 4,112,784 | 9/1978 | Cosh | 74/501.5 R |

*Primary Examiner*—Allan D. Herrmann
*Attorney, Agent, or Firm*—Michael, Best & Friedrich

[57] ABSTRACT

Disclosed herein is a marine propulsion device including a shiftable, reversing transmission located in a propulsion unit and connecting a drive shaft to a propeller shaft and a shifting mechanism including an actuating member connected to the transmission. Movement of the actuating member to shift the transmission between a neutral condition and forward drive and reverse drive conditions is effected by a shifting system including a flexible dual cable conduit assembly connected between the actuating member and a shift lever mounted for reciprocal movement. The opposite ends of the two shift cables are linked together in a manner such that the movement of the shift lever in opposite directions causes alternate pulling of the shift cables to shift the transmission.

20 Claims, 4 Drawing Figures

ACTUATION MEANS FOR MARINE PROPULSION DEVICE TRANSMISSION

BACKGROUND OF THE INVENTION

The invention relates generally to marine propulsion devices and, more particularly, to marine propulsion devices such as stern drive units and outboard motors including a reversing transmission and a shifting mechanism therefor.

Stern drive units and other marine propulsion devices commonly include a reversing transmission which connects a drive shaft to a propeller shaft and is shiftable between positions to provide neutral, forward drive and reverse drive operations. Shifting of the transmission usually is controlled by a remote control lever operably connected to the shifting mechanism through a linkage arrangement or a push-pull type cable arrangement, both of which usually have a certain amount of inherent lost motion or slop which tends to increase as the components wear with use.

This lost motion can be particularly troublesome for single lever controls arranged to control both shifting and engine throttle setting. Such controls typically include a main control lever which is movable in opposite directions from a neutral position, first through a shifting range without affecting the throttle setting, and then beyond the shifting range through a throttle range to advance engine speed without affecting shifting. Thus, shifting desirably occurs before there is appreciable throttle advance, thereby minimizing transmission wear during shifting and jerking at the time of full clutch actuation. Appreciable lost motion in the linkage connecting the main control lever to the clutch can result in significant throttle speed advance before the clutch is actuated.

SUMMARY OF THE INVENTION

The invention provides a marine propulsion device including a propulsion unit, a propeller shaft rotatably mounted in the propulsion unit and carrying a propeller, a drive shaft rotatably mounted in the propulsion unit, a reversing transmission connecting the drive shaft to the propeller shaft and shiftable between a neutral condition and a drive condition, shifting means including an actuating member mounted for movement relative to a neutral position and connected to the reversing transmission for operating the reversing transmission in response to movement of the actuating member, a clutch shift lever mounted for reciprocal movement and means connecting the shift lever to said actuating member for effecting movement of the actuating member in response to movement of the shift lever. The connecting means includes first and second cables, means operably connecting one end of the shift cables to the shift lever and connecting the other end of the shift cables to the actuating member such that, in response to movement of the shift lever in one direction, the first shift cable is pulled in a first direction for effecting movement of the actuating member in one direction relative to its neutral position and the second shift cable is moved in a second or opposite direction and such that, in response to movement of said shift lever in the other direction, the second shift cable is pulled in the first direction for effecting movement of the actuating member in the other direction relative to its neutral position and the first shift cable is moved in the second direction.

In one embodiment, the shift lever is mounted for rotational movement in opposite directions from a neutral position and one end of each of the two shift cables is connected to a part mounted for common rotation with the shift lever and having a surface extending arcuately with respect to the rotational axis of the shift lever. The shift cables are connected to the part in a manner such that, when the shift lever is rotated in one direction, a portion of one shift cable is wound onto the arcuate surface and a portion of the other shift cable is unwound from the surface and such that, when the shift lever is rotated in the opposite direction, the one shift cable is unwound from the surface and the other shift cable is wound onto the surface.

In one embodiment, the part having the arcuate surface comprises a pulley segment having a pair of axially spaced grooves. One shift cable is routed over an idler means which is spaced from the rotational axis of the shift lever and into one of the grooves, the other shift cable is routed directly into the other groove, and the shift cables are anchored on the pulley segment at circumferentially spaced locations.

In one embodiment, the actuating member is mounted for movement transversely of the propeller shaft, and the other end of each of the two shift cables is connected to a rotatable drive member which is connected to the actuating member to effect movement thereof in response to rotational movement of the drive member. The shift cables are connected to the drive member in a manner such that, in response to pulling of one shift cable, the drive member is rotated in one direction to effect movement of the actuating member in one direction transversely of the propeller shaft and such that, in response to pulling the other shift cable, the drive member is rotated in the opposite direction to effect movement of the actuating member in the other direction transversely of the propeller shaft.

In one embodiment, the shift cables are slidably carried in a flexible outer conduit or sheath which is flexibly anchored at one end and the other end of the sheath is operably connected to a cable tensioning means which biases the cable sheath in a direction opposite to the pulling direction of the shift cables to thereby maintain the shift cables under tension.

One of the principal features of the invention is the provision of a shifting system for a reversing transmission in a marine propulsion device, which system has minimum lost motion.

Another of the principal features of the invention is the provision of a dual shift cable linkage arrangement which is operable to effect shifting of a reversing transmission and is arranged so that shifting is accomplished by alternately pulling on the shift cables.

A further of the principal features of the invention is the provision of a cable linkage arrangement including means for maintaining the pulling or "working" cable under tension during use.

Further features and advantages of the invention will become apparent to those skilled in the art upon reviewing the following detailed description, the drawings and the appended claims.

Figures 1, 4:
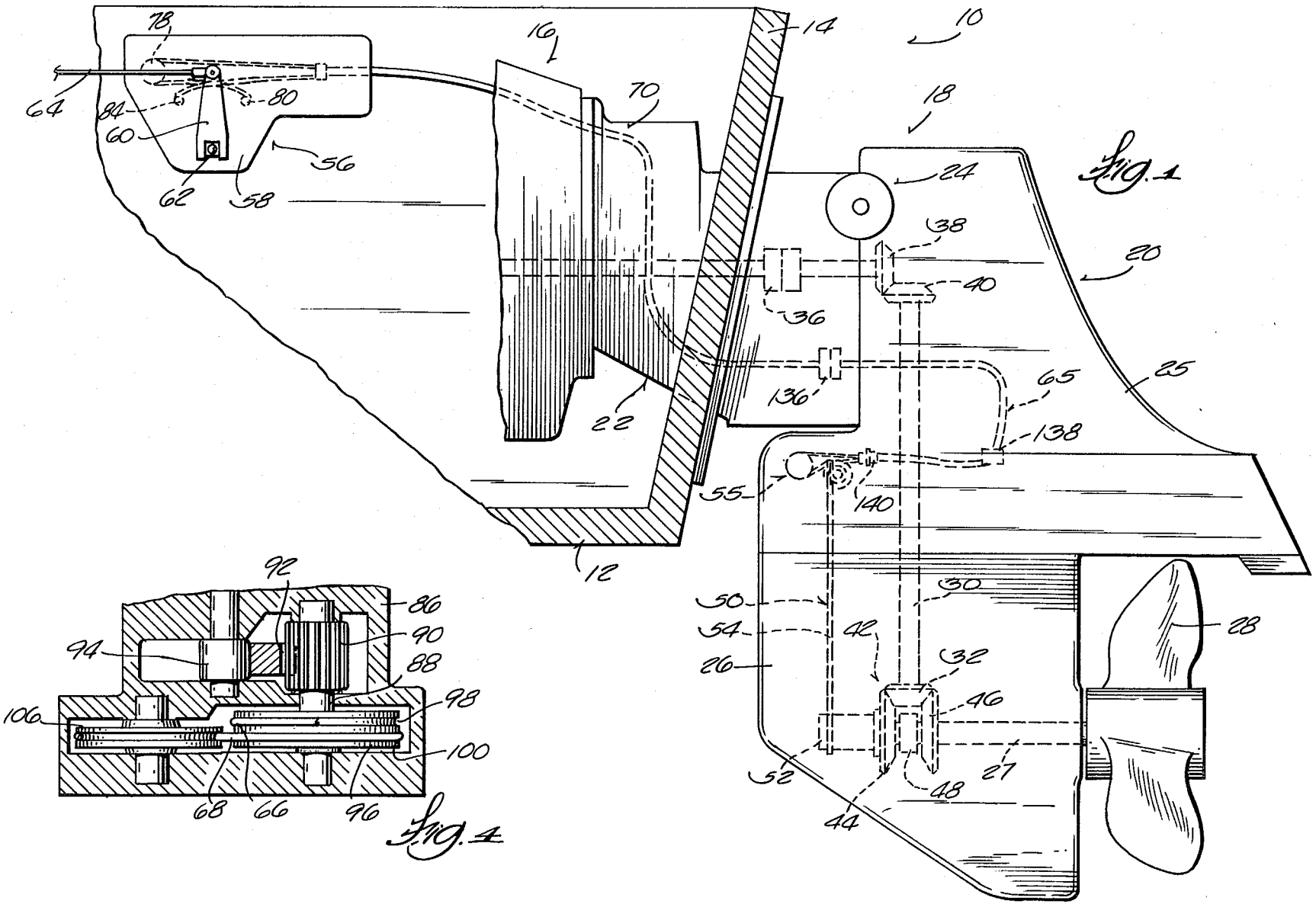
FIG. 1 is a fragmentary, side elevational view, partially in schematic, of a boat mounted stern drive unit incorporating various of the features of the invention.
FIG. 4 is a sectional view taken generally along line 4—4 in FIG. 2.

Before explaining at least one of the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purposes of description and should not be regarded as limiting.

DESCRIPTION OF THE PREFERRED EMBODIMENTS

The invention will be described for use in a stern drive unit; however, it can be adapted for use in outboard motors and other marine propulsion devices.

Illustrated in the drawing is a marine propulsion stern drive unit 10 mounted on a boat 12 having a transom 14. The stern drive unit 10 includes an engine 16 (illustrated fragmentarily) suitably mounted on the boat hull forwardly of the transom 14 and a stern drive leg or propulsion leg 18 which is fixably attached to the engine 16 and includes a lower or propulsion unit 20. The propulsion unit 20 is vertically tiltable, as well as horizontally swingable, relative to engine 16.

While various propulsion leg constructions can be used, in a specific construction illustrated, the propulsion leg 18 is constructed generally in accordance with the Shimanckas U.S. Pat. No. 3,183,880, issued May 18, 1965, which patent is incorporated herein by reference. As used herein, the term "stern drive leg" and "propulsion leg" encompasses the intermediate unit A, the propulsion unit B, and the swivel support C disclosed in the above-identified Shimanckas patent, which assembly or units are designated generally in the present drawings by the reference numerals 22, 20 and 24, respectively.

The propulsion unit 20 includes an exhaust housing 25 and a lower gearcase 26. Rotatably mounted in the gearcase 26 is a propeller shaft 27 carrying a propeller 28. Rotatably mounted within the propulsion unit 20 is a drive shaft 30 extending transversely of the propeller shaft 27 and carrying a bevel gear 32 on the lower end. Rotatably mounted within the intermediate unit 22 is a power shaft 34 which is operably connected at one end to the engine crankshaft (not shown) and is drivingly connected at the other end to the drive shaft 30 via a gear-type universal fitting 36 (illustrated schematically and corresponding generally to fittings 73 and 78 in the above-identified Shimanckas patent). The drive shaft 30 is connected to the propeller shaft 27 through a reversing clutch or transmission 42.

While various arrangements can be used, in the specific construction illustrated, the reversing transmission 42 includes a pair of axially spaced bevel gears 44 and 46 which are mounted for rotation coaxially with and independently of the propeller shaft 27 and mesh with the drive gear 32. The transmission 42 also includes a clutch dog 48 which is carried on the propeller shaft 27 intermediate the bevel gears 44 and 46 for common rotation with propeller shaft 27 and for axial movement relative to propeller shaft 27 between a central or neutral position out of engagement with the bevel gears 44 and 46, a forward drive position (to the left of the neutral position) in driven rotary engagement with the bevel gear 44 and a reverse drive position (to the right of the neutral position) in driven rotary engagement with the bevel gear 46.

The clutch dog 48 is moved between the neutral, forward drive, and reverse drive positions by a shift mechanism 50 including a shift actuator 52 which is operably connected to the clutch dog 48 and is mounted for common axial movement therewith relative to the propeller shaft 27 while affording rotation of the propeller shaft 27 relative to both the clutch dog 48 and the shift actuator 52. The shift mechanism 50 also includes an actuating rod or member 54 which is supported within the propulsion unit for reciprocal movement transversely of the propeller shaft axis between the illustrated neutral position and forward and reverse drive positions. The actuating member 54 is connected to the shift actuator 52 to effect axial movement of the shift actuator 52, and thus axial movement of the clutch dog 48, relative to the propeller shaft 27 in response to movement of the actuating member 54 transversely of the propeller shaft axis. In the specific construction illustrated, downward movement of the actuating member 54 causes the shift actuator 52 to be moved to the left while upward movement causes the shift actuator 52 to be moved to the right.

Various suitable arrangements can be used for connecting the actuating member 54 to the shift actuator 52 and for connecting the shift actuator 52 to the clutch dog 48 to provide the shifting operation described above. The Hagen U.S. Pat. No. 3,919,964, issued Nov. 18, 1975, describes a particularly suitable arrangement, which patent is incorporated herein by reference. The transmission and shifting mechanism are conventional and the specific arrangement of the various components thereof does not constitute part of the invention. Accordingly, these assemblies are illustrated schematically for purposes of simplification.

Selective movement of the actuating member 54 to shift the transmission is effected by the operator, as will be more fully explained, through a lower shift unit 55 mounted inside the propulsion unit 20 at the juncture between the exhaust housing 25 and the gearcase 26 and mechanically connected to the upper end of the actuating member 54 and a shift converter unit 56 located inside the boat and preferably mounted on the engine 16. The shift converter unit 56 includes a housing 58, a shift arm or lever 60 affixed on a shaft 62 which is rotatably mounted on the housing 58 for affording rotational movement of the shift lever 60 relative to and exteriorly of the housing 58. The shift lever 60 is operably connected, via a suitable linkage such as a push-pull cable 64, to a main control lever (not shown) for rotational movement in opposite directions from a neutral position in response to movement of the main control lever by the operator. The shift lever 60 is shown in the neutral position.

Means are provided for connecting the shift lever 60 to the actuating member 54, via the lower shift unit 55, to vertically or axially displace the actuating member 54 (i.e. move the actuating member 54 transversely of the propeller shaft axis) in response to rotational movement of the shift lever 60 and thereby displace the shift actuator 52 and the connected clutch dog 48 (i.e., move these components axially relative to the propeller shaft 27) to operate the transmission 42.

More specifically, such means comprises a flexible dual pull-pull type cable conduit assembly 65 including first and second flexible shift cables 66 and 68 slidably disposed inside a flexible outer conduit or sheath 70 and extending outwardly beyond the opposite ends of the sheath 70. The cable assembly 65 extends through the interior of the intermediate unit 22 and through the propulsion unit 20 with one end of the sheath 70 connected to the shift converter unit 56 and the other end connected to the lower shift unit 55.

Means are provided for connecting the opposite ends of each of the shift cables 66 and 68 to the shift lever 60 and to the upper end of the actuating member 54 so that movement of one shift cable causes movement of the other shift cable in the opposite direction and the "working" cable is in tension, i.e. is pulled to effect movement of the actuating member 54. That is, the first shift cable 66, in response to rotational movement of the shift lever 60 in one direction, is pulled in a first direction to effect movement of the actuating member 54 in one direction while the second shift cable 68 is moved in the opposite or second direction and the second shift cable 68, in response to rotational movement of the shift lever 60 in the opposite direction, also is pulled the first direction to effect movement of the actuating member 54 in the opposite direction while the first shift cable is moved in the second direction.

While various arrangements can be used, in a specific construction illustrated, the shift converter unit 56 includes a part or pulley segment 72 which is mounted on the shaft 62 for common rotation with the shaft 62 and with the shift lever 60. The pulley segment 72 has a pair of axially spaced grooves 74 and 76 which extends arcuately with respect to the rotational axis of the shift lever 60. One end portion of the first shift cable 66 is trained over an idler pulley 78 rotatably mounted within the shift converter unit housing 58 in spaced relation to the shaft 62, is received in the pulley segment groove 74, and is anchored to the pulley segment 72 by an end fitting 80 thereon which fits into a mating pocket 82 in the pulley segment 72. One end portion of the second shift cable 68 is received directly in the pulley segment groove 76 and is anchored to the pulley segment 72 by an end fitting 84 thereon which fits into a pocket 85 circumferentially spaced from the pocket 82.

As viewed in the drawings, clockwise movement of the shift lever 60, in response to a pushing movement on the push-pull cable 64, causes the first shift cable 66 to be wound onto the pulley segment 72, and thus pulled to the left, while the second shift cable 68 is unwound from the pulley segment 72. Counterclockwise movement of the shift lever 60, in response to a pulling movement on the push-pull cable 64, causes the second shift cable 68 to be wound onto the pulley segment 72, and thus also pulled to the left, while the first shift cable 66 is unwound from the pulley segment 72. Thus, the push-pull motion of the remote control via the cable 64 is converted to an alternate pulling movement of the first and second shaft cables 66 and 68. This pull-pull motion is translated to the actuating member 54 by the lower shift unit 55.

The lower shift unit 55 includes a housing 86 mounted in the gearcase 26 adjacent the upper end of the actuating member 54 and a shaft 88 rotatably supported in the housing 86 and having a pinion 90 which meshes with a rack section 92 provided on the upper end portion of the actuating member 54. The rack section 92 of the actuating member 54 is maintained in the meshing engagement with the pinion 90 by a roller 94 rotatably supported inside the housing 86 in spaced relationship with the pinion shaft 88. The lower shift unit 55 also includes a drive member or pulley 96 which is mounted on the pinion shaft 88 for common rotation therewith and has a pair of axially spaced grooves 98 and 100.

The other end portion of the first shift cable 66 is received directly in the drive pulley groove 98 and is anchored to the drive pulley 96 by an end fitting 102 thereon which fits into a mating pocket 104 in the drive pulley 96. The other end of the second shift cable 68 is trained over an idler pulley 106 rotatably mounted within the housing 86 in spaced relationship to the pinion shaft 88, is received in the drive pulley groove 100, and is anchored to the drive pulley 96 by an end fitting 108 thereon which fits into a mating pocket 110 circumferentially spaced from the pocket 104.

As viewed in the drawings, clockwise rotation of the drive pulley 96, and thus clockwise rotation of the pinion 90, in response to pulling movement of the first shift cable 66, causes the actuating member 54 to move upwardly and transversely of the propeller shaft axis from the illustrated neutral position. This upward movement of the actuating member 54 causes the clutch dog 48 to be shifted, via the shift actuator 52, to the right from the illustrated neutral position into engagement with the bevel gear 46 to place the transmission 42 in the reverse drive condition.

Counterclockwise rotation of the drive pulley 96, in response to pulling movement of the second shift cable 68, causes the actuating member 54 to move downwardly and transversely of the propeller shaft axis from the neutral position. This downward movement of the actuating member 54 causes the clutch dog to be shifted to the left from the neutral position into engagement with the bevel gear 44 to place the transmission 42 on the forward drive position.

From the above, it can be seen that shifting of the transmission 42 from the forward drive condition to the neutral position is effected by pulling on the first shift cable while shifting from the reverse drive condition to the neutral position is effected by pulling on the second shift cable 68. Thus, shifting of the transmission 42 in either direction (i.e., forward-neutral-reverse and reverse-neutral-forward) is effected by alternately pulling the first and second shift cable 66 and 68.

If desired, hydraulic means, such as the hydraulic servo mechanism disclosed in the above-identified Hagen patent, can be provided in conjunction with the actuating member 54 to assist movement thereof and thereby facilitate operation of the transmission 42.

Any appreciable slack in the cables 66 and 68, caused for example by stretching during use or the accumulation of manufacturing tolerances at the time of assembly, can translate into lost motion in the shifting assembly. To minimize this potentiality, means preferably are provided for preloading on the cable assembly sheath 70 in a direction opposite the pulling direction of the shift cables 66 and 68 so as to bow the sheath 70 and thereby maintain the shift cables substantially taut.

Figures 2, 3:
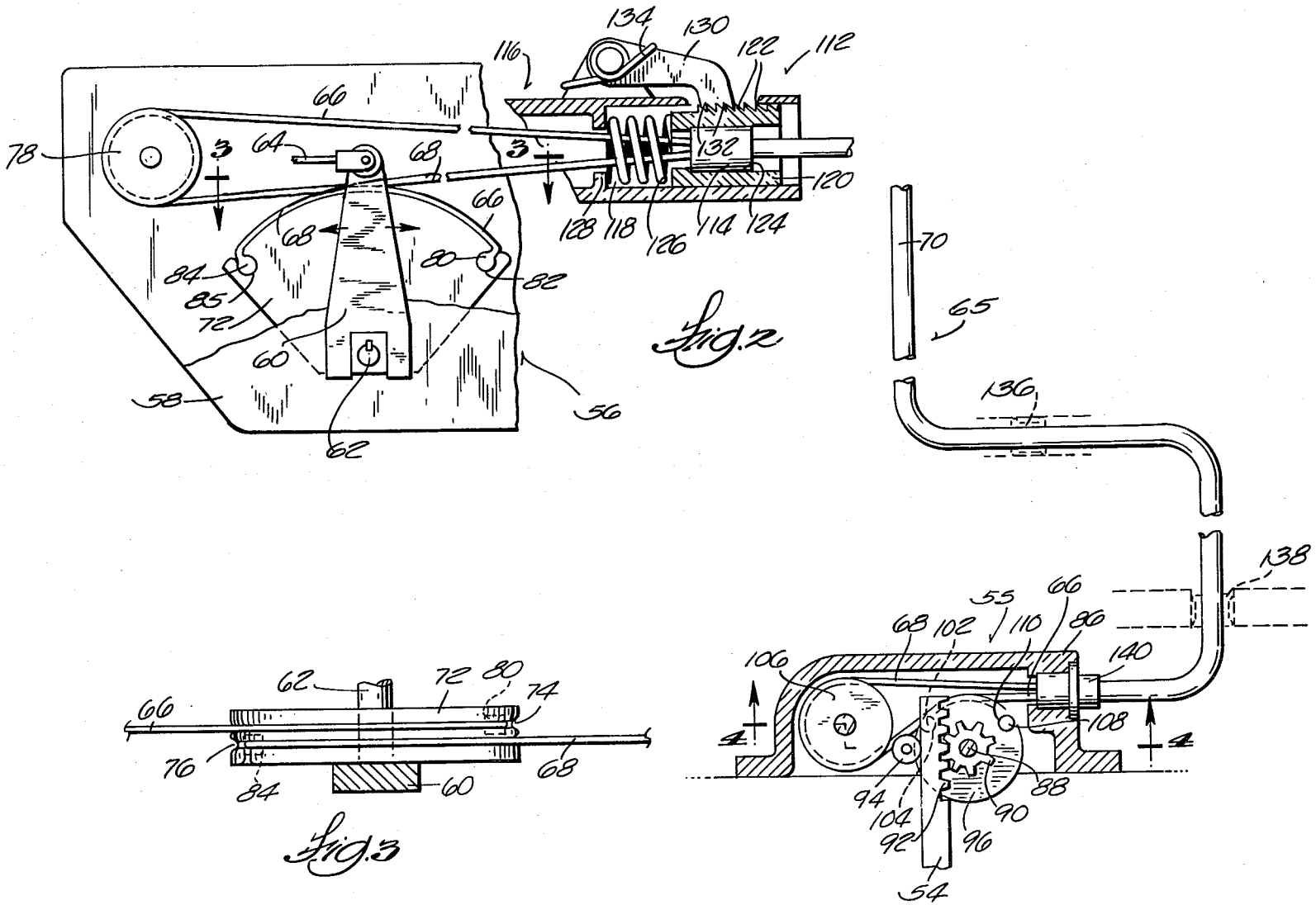
FIG. 2 is an enlarged, fragmentary view, partially broken away, of a portion of the stern drive unit shown in FIG. 1.
FIG. 3 is a sectional view taken generally along line 3—3 in FIG. 2.

While various arrangements can be used, in the specific construction illustrated, such means comprises fixably anchoring one end or portion of the cable assembly sheath 70 and providing a cable tensioning unit 112 on the shift converter unit 56 for receiving an end fitting 114 provided on the other end of the sheath 70. More specifically, the tensioning unit 112 includes a stationary fixture including a cable guide 116 which can be formed as an integral part of the shift converter unit 58 and has an internal guideway or bore 118 through which the shift cables 66 and 68 extend. Slidably mounted in the outer end portion of the bore 118 is a hollow element or rack 120 including a plurality of ratchet teeth 122 on an outer surface thereof and a recess or pocket 124 for receiving the sheath end fitting 114. The rack 120 is biased in an axial direction opposite the pulling direction to the shift cables 66 and 68, i.e. to the right as viewed in FIG. 2, by a compression spring 126 disposed in the guide bore 118 with one end bearing against the rack 120 and the other end bearing against an interior shoulder 128 provided in the guide bore 118.

Inward axial movement of the rack 120 against the biasing force of the spring 126 is prevented by one or more pawls 130, each of which is pivotally mounted on the shift converter unit housing 58 and includes teeth 132 which are biased into engagement with the rack teeth 122 by a torsion spring 134 connected to each pawl 130. The pawl teeth 130 and the rack teeth 122 are arranged to permit outward axial movement of the rack 120 by the spring 126.

During assembly, the shift cables 66 and 68 are fed through the guide bore 118 and the spring 126 and the sheath end fitting 114 is placed inside the rack pocket 124 with the spring 126 compressed. After the shift cables 66 and 68 have been properly routed over the idler pulley 78 and the pulley segment 72 and the end fittings 80 and 84 have been fitted into their respective pockets 82 and 85, the spring 126 is released. The spring 126 forces the rack 120 axially outwardly to apply a tension on or bow the cable assembly sheath 70 and thereby maintain the shift cables 66 and 68 substantially taut. The pawl(s) prevents the cable assembly 65 from moving axially inwardly toward the pulley segment 72 when the shift 66 and 68 are pulled during the shifting operation. If the shift cables cables 66 and 68 stretch or otherwise tend to develop slack during use, the spring 126 moves the rack 120 further axially outwardly to cause an additional bow in the sheath 70 and thereby maintain the shift cables 66 and 68 substantially taut.

As alluded to above, the cable assembly 65 can, for the most part, be located inside the stern drive unit and is routed therethrough in circuitous manner so as to not interfere with full steering, full tilting, and full engine trim on units so equipped. The openings in the intermediate unit housing, the exhaust housing and the lower shift unit housing for accomodating the cable assembly 65 can be sealed by respective molded rubber fittings 136, 138 and 140.

Various of the features of the invention are set forth in the following claims:

What is claimed is:

1. A marine propulsion device comprising a propulsion unit, a propeller shaft rotatably mounted in said propulsion unit and carrying a propeller, a drive shaft rotatably mounted in said propulsion unit, a reversing transmission connecting said drive shaft to said propeller shaft and shiftable between a neutral condition and a drive condition, shifting means including an actuating member mounted in said propulsion unit for reciprocal movement relative to a neutral position and connected to said reversing transmission for operating said reversing transmission in response to movement of said actuating member, a clutch shift lever mounted for reciprocal movement, and means connecting said shift lever to said actuating member for effecting movement of said actuating member in response to movement of said shift lever, said connecting means including first and second flexible shift cables each having a first end and a second end, means operably connecting said first ends of said shift cables to said shift lever and connecting said second ends of said shift cables to said actuating member such that, in response to movement of said shift lever in one direction, said first shift cable is pulled in a first direction for effecting movement of said actuating member in one direction relative to its neutral position and said second shift cable is moved in a second direction opposite to said first direction and such that, in response to movement of said shift lever in the other direction, said second shift cable is pulled in said first direction for effecting movement of said actuating member in the other direction relative to its neutral position and said first shift cable is moved in said second direction.

2. A marine propulsion device according to claim 1 wherein said shift lever is mounted for rotational movement in opposite directions from a neutral position, wherein said means connecting said first ends of said shift cables to said shift lever includes a part mounted for common rotation with said shift lever and having a surface extending arcuately with respect to the rotational axis of said shift lever, and means connecting said first ends of said shift cables to said part such that when said shift lever is rotated in one direction a portion of one of said shift cables is wound unto said surface and a portion of the other of said shift cables is unwound from said surface.

3. A marine propulsion device according to claim 2 wherein said part comprises a pulley segment having a pair of axially spaced grooves for receiving a portion of a respective one of said shift cables, and wherein said means connecting said first ends of said shift cables to said part includes an idler means spaced from the rotational axis of said shift lever and means for anchoring said first ends of said shift cables at circumferentially spaced locations on said pulley segment, one of said shift cables being routed over said idler means and into one of said pulley segment grooves and the other of said shift cables being routed directly into the other of said pulley segment grooves.

4. A marine propulsion device according to claim 1 wherein said actuating member is mounted for movement transversely of said propeller shaft to operate said reversing transmission, and wherein said means connecting said second ends of said shift cables to said actuating member includes a rotatable drive member, means connecting said drive member to said actuating member for effecting movement of said actuating member in response to rotational movement of said drive member, and means connecting said second ends of said shift cables to said drive member such that, in response to pulling of said first shift cable in said first direction, said drive member is rotated in one direction to effect movement of said actuating member in one direction transversely of said propeller shaft and such that, in response to pulling of said second shift cable in said first direction, said drive member is rotated in the opposite direction to effect movement of said actuating member in the other direction transversely of said propeller shaft.

5. A marine propulsion device according to claim 4 wherein said drive member comprises a drive pulley having a pair of axially spaced grooves for receiving a portion of a respective one of said shift cables, and wherein said means connecting said second ends of said shift cables to said drive member includes an idler means spaced from the rotational axis of said drive pulley and means for anchoring said second ends of said shift cables at circumferentially spaced locations on said drive pulley, one of said shift cables being routed over said idler means and into one of said drive pulley grooves and the other of said shift cables being routed directly into one of said drive pulley grooves.

6. A marine propulsion device according to claim 5 wherein said means connecting said drive member to said actuating member includes a pinion mounted for common rotation with said drive pulley and a rack section on said actuating member meshing with said pinion.

7. A marine propulsion device according to claim 1 wherein said shift cables are slidably carried in a flexible outer sheath having a first end and a second end fixably anchored, and wherein said device further includes means operably connected to said first end of said sheath for biasing said sheath in said second direction and thereby maintaining said shift cables substantially taut.

8. A marine propulsion device according to claim 7 wherein said sheath biasing means includes an end fitting on said first end of said first sheath, a stationary fixture including an internal guideway through which said first ends of said shift cables extend enroute to connection to said shift lever, an element slidably mounted in said guideway and including a pocket for receiving said sheath end fitting, spring means disposed inside said guideway and acting on said element to bias said end fitting in said second direction, and means on said fixture releasably engaging said element for permitting movement of said element in said second direction and for preventing movement of said element in said first direction.

9. A marine propulsion device according to claim 8 wherein said last mentioned means includes ratchet teeth on said element, a pawl pivotally mounted on said fixture and having teeth which are meshable with said element teeth, and means on said fixture and on said pawl for biasing said pawl teeth into said releasable engagement with said element teeth.

10. A marine propulsion device comprising a propulsion unit, a propeller shaft rotatably mounted in said propulsion unit and carrying a propeller, a drive shaft rotatably mounted in said propulsion unit, a reversing transmission connecting said drive shaft to said propeller shaft and shiftable between a neutral condition and forward and reverse drive conditions, shifting means including an actuating member mounted in said propulsion unit for movement transversely of said propeller shaft and connected to said reversing transmission for operating said reversing transmission in response to movement of said actuating member, a clutch shift lever mounted for rotational movement in opposite directions from a neutral position, and means connecting said shift lever to said actuating member for effecting movement of said actuating member in response to movement of said shift lever, said connecting means including first and second flexible shift cables, each having a first end and a second end, a part mounted for common rotation with said shift lever and having a surface extending arcuately with respect to the rotational axis of said shift lever, means connecting said first ends of said shift cables to said part such that, in response to rotational movement of said shift lever in one direction, a portion of said first shift cable is wound onto said surface and thereby pulled in a first direction while a portion of said second shift cable is unwound from said surface and thereby moved in a second direction opposite to said first direction and such that, in response to rotational movement of said shift lever in the opposite direction, a portion of said second shift cable is wound onto said surface and thereby pulled in said first direction while a portion of said first shift cable is unwound from said surface and thereby moved in said second direction, a rotatable drive member drivingly connected to said actuating member for effecting movement of said actuating member in response to rotational movement of said drive member, means connecting said second ends of said shift cables to said drive member such that, in response to pulling said first shift cable in said first direction, said drive member is rotated in one direction to effect movement of said actuating member in one direction transversely of the propeller shaft and such that, in response to pulling said second shift cable in said first direction, said drive member is rotated in the opposite direction to effect movement of said actuating member in the other direction transversely of the propeller shaft.

11. A marine propulsion device according to claim 10 wherein said part comprises a pulley segment having a pair of axially spaced grooves for receiving an end portion of a respective one of said shift cables, and wherein said means connecting said first ends of shift cables to said part includes an idler means spaced from the rotational axis of said shift lever and means for anchoring said first ends of said shift cables at circumferentially spaced locations on said pulley segment, one of said shift cables being routed over said idler means and into one of said pulley segment grooves and the other of said shift cables being routed directly into the other of said pulley segment grooves.

12. A marine propulsion device according to claim 11 wherein said shift cables are slidably carried in a flexible outer sheath having a first end and a second end fixably anchored, and wherein said device further includes means operably connected to said first end of said sheath for biasing said sheath in said second direction and thereby maintaining said shift cables substantially taut.

13. A marine propulsion device according to claim 12 wherein said sheath biasing means includes an end fitting on said end of said first sheath, a stationary fixture including an internal guideway through which said first ends of said shift cables extend enroute to connection to said shift lever, an element slidably mounted in said guideway and including a pocket for receiving said sheath end fitting, spring means disposed inside said guideway and acting on said element to bias said end fitting in said second direction, and means on said fixture releasably engaging said element for permitting movement of said element in said second direction and for preventing movement of said element in said first direction.

14. A marine propulsion device according to claim 13 wherein said last-mentioned means includes ratchet teeth on said element, a pawl pivotally mounted on said fixture and having teeth which are meshable with said element teeth, and means on said fixture and on said pawl for biasing said pawl teeth into said releasable engagement with said element teeth.

15. A marine propulsion device according to claims 10 or 11 wherein said drive member comprises a drive pulley having a pair of axially spaced grooves for receiving a portion of a respective one of said shift cables, and wherein said means connecting said second ends of said shift cables to said drive member includes an idler means spaced from the rotational axis of said drive pulley and means for anchoring said second ends of said shift cables at circumferentially spaced locations on said drive pulley, one of said shift cables being routed over said idler means and into one of said drive pulley grooves and the other of said shift cables being routed directly into one of said drive pulley grooves.

16. A marine propulsion device according to claim 15 wherein said means connecting said drive member to said actuating member includes a pinion mounted for common rotation with said drive pulley and a rack section on said actuating member meshing with said pinion.

17. A marine propulsion device according to claim 16 wherein said shift cables are slidably carried in a flexible outer sheath having a first end and a second end fixably anchored, and wherein said device further includes means operably connected to said first end of said sheath for biasing said sheath in said second direction and thereby maintaining said shift cables substantially taut.

18. A marine propulsion device according to claim 17 wherein said sheath biasing means includes an end fitting on said first end of said sheath, a stationary fixture including an internal guideway through which said first ends of said shift cables extend enroute to connection to said shift lever, an element slidably mounted in said guideway and including a pocket for receiving said sheath end fitting, spring means disposed inside said guideway and acting on said element to bias said end fitting in said second direction, and means on said fixture releasably engaging said element for permitting movement of said element in said second direction and for preventing movement of said element in said first direction.

19. A marine propulsion device according to claim 15 wherein said shift cables are slidably carried in a flexible outer sheath having a first end and a second end fixably anchored, and wherein said device further includes means operably connected to said first end of said sheath for biasing said sheath in said second direction and thereby maintaining said shift cables substantially taut.

20. A marine propulsion device according to claim 19 wherein said sheath biasing means includes an end fitting on said first end of said sheath, a stationary fixture including an internal guideway through which said first ends of said shift cables extend enroute to connection to said shift lever, an element slidably mounted on said guideway and including a pocket for receiving said sheath end fitting, spring means disposed inside said guideway and acting on said element to bias said end fitting in said second direction, and means on said fixture releasably engaging said element for permitting movement of said element in said second direction and for preventing movement of said element in said first direction.

* * * * *